US007841149B2

(12) United States Patent
Jahn et al.

(10) Patent No.: US 7,841,149 B2
(45) Date of Patent: Nov. 30, 2010

(54) CONCEALED CEILING PANEL SYSTEM

(75) Inventors: Peter G. Jahn, Palos Park, IL (US); Scott G. Jankovec, Elmhurst, IL (US); Thomas E. Smith, Darien, IL (US)

(73) Assignee: Chicago Metallic Corporation, Chicago, IL (US)

( * ) Notice: Subject to any disclaimer, the term of this patent is extended or adjusted under 35 U.S.C. 154(b) by 165 days.

(21) Appl. No.: 11/871,482

(22) Filed: Oct. 12, 2007

(65) Prior Publication Data

US 2008/0086962 A1 Apr. 17, 2008

Related U.S. Application Data

(60) Provisional application No. 60/852,044, filed on Oct. 16, 2006.

(51) Int. Cl.
*E04B 2/00* (2006.01)
*E04B 5/00* (2006.01)
*E04B 9/00* (2006.01)

(52) U.S. Cl. ..... 52/506.08; 52/220.6; 52/489.1

(58) Field of Classification Search ..... 52/506.06, 52/506.07, 506.08, 506.09, 220.6, 489.1
See application file for complete search history.

(56) References Cited

U.S. PATENT DOCUMENTS 3,550,341 A * 12/1970 Thompson ..... 52/506.09
3,596,425 A 8/1971 Kodaras
3,740,916 A 6/1973 Kenaga
3,875,717 A * 4/1975 Moeller ..... 52/506.08
4,089,146 A 5/1978 Martinez
4,377,059 A 3/1983 Kuhr
4,463,537 A 8/1984 Rodriquez et al.
4,760,677 A 8/1988 Nassof (Continued)

FOREIGN PATENT DOCUMENTS

CA 1279771 12/1984

(Continued)

OTHER PUBLICATIONS

Chicago Metallic Corporation CurvGrid™ Design Guide, © 2005.

(Continued)

*Primary Examiner*—Richard E Chilcot, Jr.
*Assistant Examiner*—Theodore Adamos
(74) *Attorney, Agent, or Firm*—Cook Alex Ltd.

(57) ABSTRACT

A flexible ceiling panel is preferably formed from sheet metal, such as aluminum sheet. Each ceiling panel has a generally rectangular shape (corresponding in width to the spacing between the main runners) and is formed with a hem on all four edges. A series of bendable tabs are formed integrally with the hem of the panel. To secure the panel to the associated grid system, the tabs are folded upwardly and outwardly from the panel along two axes to secure the panel to the grid system. Alternatively, a plurality of separate spring clips is used to secure the panel to the grid system. Each clip includes a first leg adapted to have at least a portion thereof received in the hem of the ceiling panel. A second leg extends generally perpendicularly from the first leg and includes a detent extending toward the first leg, the detent being adapted to secure the clip to the flange of the runner.

8 Claims, 4 Drawing Sheets

U.S. PATENT DOCUMENTS

| | | | | |
|---|---|---|---|---|
| 4,848,054 | A | 7/1989 | Blitzer et al. | |
| 4,901,485 | A * | 2/1990 | Menchetti et al. | 52/145 |
| 5,024,034 | A * | 6/1991 | Gailey | 52/506.07 |
| 5,123,225 | A | 6/1992 | Goodworth | |
| 5,149,221 | A * | 9/1992 | Slapsys | 403/201 |
| 5,311,719 | A * | 5/1994 | Jahn | 52/506.09 |
| 5,428,930 | A | 7/1995 | Bagley et al. | |
| 5,482,240 | A | 1/1996 | Caraher | |
| 5,535,566 | A | 7/1996 | Wilson et al. | |
| 5,619,833 | A | 4/1997 | Neff | |
| 5,692,346 | A * | 12/1997 | Irvine et al. | 52/506.09 |
| 5,732,521 | A | 3/1998 | Schmitt-Raiser | |
| 5,822,941 | A | 10/1998 | Kinsella | |
| 5,893,250 | A | 4/1999 | Benvenuto | |
| 6,018,923 | A * | 2/2000 | Wendt | 52/712 |
| 6,029,413 | A | 2/2000 | Compas, Jr. | |
| 6,047,517 | A | 4/2000 | Vrame | |
| 6,079,177 | A | 6/2000 | Halchuck | |
| 6,092,777 | A | 7/2000 | Kuntz | |
| 6,101,777 | A | 8/2000 | Bodine | |
| 6,199,377 | B1 | 3/2001 | Colson | |
| 6,260,325 | B1 | 7/2001 | Wendt et al. | |
| 6,314,698 | B1 | 11/2001 | Johnansson | |
| 6,338,288 | B1 | 1/2002 | Chevalier | |
| 6,446,406 | B1 | 9/2002 | Sauer | |
| 6,467,228 | B1 | 10/2002 | Wendt | |
| 6,477,815 | B2 | 11/2002 | Paul | |
| 6,532,706 | B1 | 3/2003 | Scott | |
| 6,725,608 | B1 | 4/2004 | Kraus | |
| 6,880,302 | B1 | 4/2005 | Fontaine | |
| 6,892,500 | B2 | 5/2005 | Zaborowski | |
| 6,935,085 | B2 | 8/2005 | Little, Jr. | |
| 2003/0192268 | A1 | 10/2003 | Zaborowski | |
| 2003/0213200 | A1 | 11/2003 | Hornidge | |
| 2004/0055239 | A1 | 3/2004 | Hang | |
| 2004/0182022 | A1 | 9/2004 | Stackenwalt | |
| 2004/0231271 | A1 | 11/2004 | Bruno | |
| 2005/0000184 | A1 | 1/2005 | Nanayakkara | |
| 2005/0066604 | A1 | 3/2005 | Kinzler | |
| 2005/0252155 | A1 | 11/2005 | Weir | |
| 2006/0005495 | A1 * | 1/2006 | Stessel et al. | 52/506.07 |
| 2006/0064939 | A1 | 3/2006 | Kelley et al. | |
| 2006/0096234 | A1 | 5/2006 | Miller, Jr. | |

FOREIGN PATENT DOCUMENTS

| | | | |
|---|---|---|---|
| CA | 2221088 | | 11/1997 |
| DE | 197 02 099 | A1 | 7/1998 |
| DE | 298 04 242 | U1 | 8/1998 |
| EP | 0 855 477 | A2 | 7/1998 |
| GB | 1277923 | | 6/1972 |

OTHER PUBLICATIONS

Chicago Metallic Corporation CurvGrid™ Installation Instructions, © 2004.

Chicago Metallic Corporation the Planostile™ Grove All Metal Ceiling Systems Specification Guide, © 2001.

Chicago Metallic Corporation CurvGrid Concealed Z System Standard Ceiling System Specification Guide, © 2000.

* cited by examiner

FIG. 8
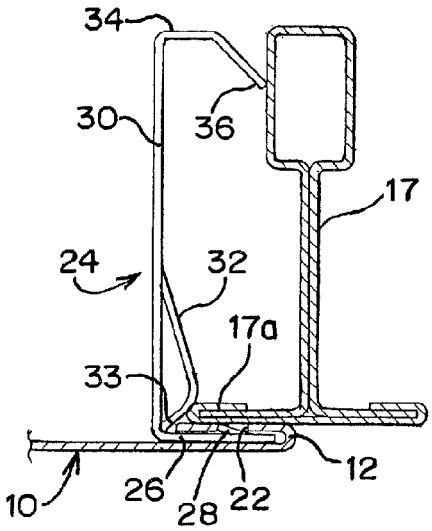
FIG. 9
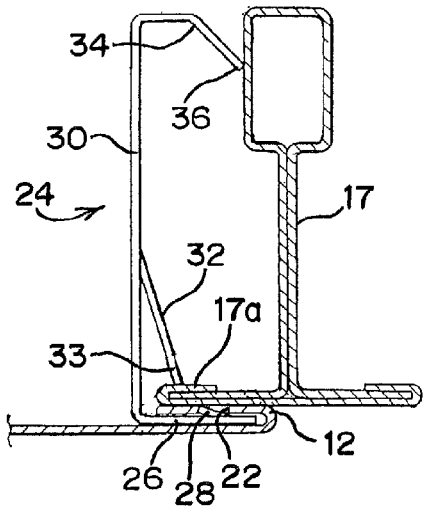
FIG. 10
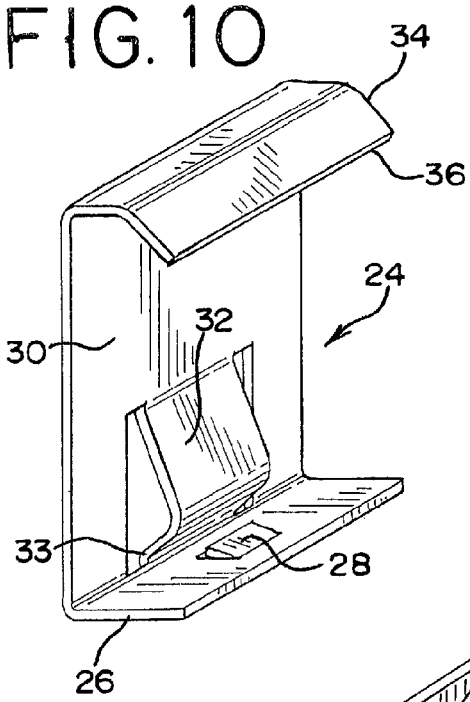
FIG. 11
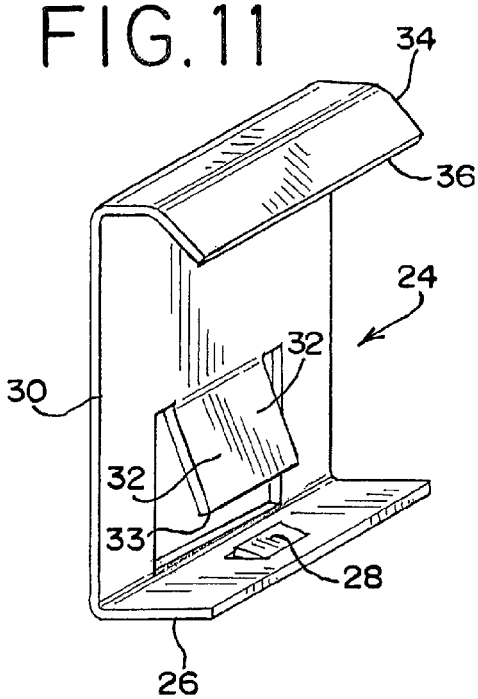
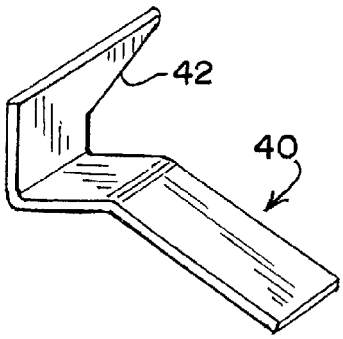
FIG. 12

CONCEALED CEILING PANEL SYSTEM

CROSS-REFERENCE TO RELATED APPLICATION

This application claims the benefit of the filing date of U.S. Provisional Patent Appln. Ser. No. 60/852,044 filed Oct. 16, 2006.

FIELD AND BACKGROUND

The present invention relates to a suspended ceiling system and, more particularly, a ceiling panel adapted for use in a curved suspended ceiling system in which the suspension grid is substantially concealed from view by the ceiling panels and in which the panels can be shipped in a flat configuration. In one aspect of the invention, the ceiling panel includes tabs formed integrally therewith for attaching the ceiling panel to the suspension grid. In a second aspect, a clip is provided for securing the ceiling panel to a suspension grid.

Curved suspended ceiling systems are becoming increasingly popular. An exemplary curved suspended ceiling system is shown in our co-pending U.S. application Ser. No. 11/257,726, filed Oct. 25, 2005 (U.S. Publication No. 2006/0101764), which is incorporated herein by reference. This application discloses a unique curved suspension grid system in which the main runners are secured to a plurality of primary carriers that are oriented transversely to the main runners and extend substantially the width of the suspended ceiling.

As shown in the referenced application, the ceiling panels are supported directly on the top surfaces of the flanges of the main runners, as is typical in many suspended ceiling systems, and are secured in place by hold-down clips that are placed over the reinforcing bulb of the runner. However, it is sometimes desirable, usually for aesthetic reasons, to disguise or hide the supporting grid system for the panels. While this has been done for flat ceiling grids, the problems of creating a curved ceiling panel system that substantially conceals the support grid system have not been adequately addressed before the present invention.

SUMMARY OF THE INVENTION

The present invention comprises a novel flexible ceiling panel preferably formed from sheet metal, such as aluminum sheet. Each ceiling panel has a generally rectangular shape (corresponding in width to the spacing between the main runners) and is formed with a hem on all four edges.

Two different approaches for securing the panels to the grid system are contemplated. In a first embodiment of the present invention, a series of bendable tabs are formed integrally with the hem of the panel. To secure the panel to the associated grid system, the tabs are folded upwardly and outwardly from the panel along two axes to secure the panel to the grid system.

In a second embodiment, a plurality of separate spring clips is used to secure the panel to the grid system. Each clip includes a first leg adapted to have at least a portion thereof received in the hem of the ceiling panel. A second leg extends generally perpendicularly from the first leg and includes a detent extending toward the first leg, the detent being adapted to secure the clip to the flange of the runner. In one embodiment of the clip, the detent is adapted to engage an edge of the flange of the runner. In a second embodiment, the detent is adapted to engage an upper surface of the flange of the runner.

In a further aspect of the clip, the clip may include an angled segment extending from the second leg having a free end that is adapted to engage the flange of the runner during installation of the ceiling panel into the support grid.

BRIEF DESCRIPTION OF THE DRAWINGS

FIGS. 6, 8 and 10 illustrate a clip for securing a hemmed ceiling panel to a grid member, with FIG. 6 being a perspective view showing the relationship between the clip, the ceiling panel and the grid member, FIG. 8 being a cross-sectional view taken along line 8-8 of FIG. 6, and FIG. 10 being a perspective view of the clip.

FIGS. 7, 9 and 11 illustrate a variation of the clip of FIGS. 6, 8 and 10 for securing a hemmed ceiling panel to a grid member.

FIG. 12 is a perspective view of a tool designed to assist in removal of a ceiling panel secured to a grid member by the clip of FIGS. 7, 9 and 11.

DETAILED DESCRIPTION

Figure 1:
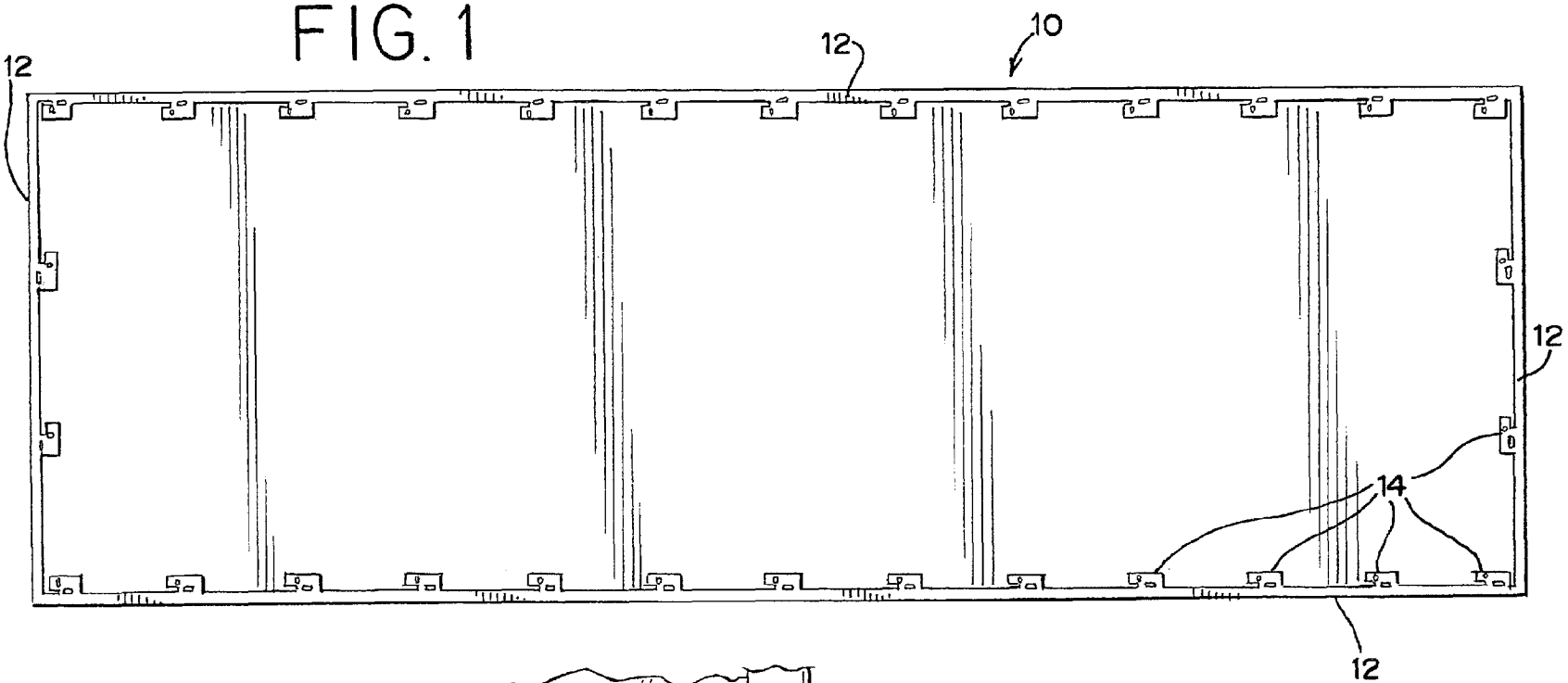
FIG. 1 is a plan view of a ceiling panel according to a first embodiment of the present invention.

With reference to the accompanying drawings, the basic construction of a flexible ceiling panel 10 in accordance with the present invention is shown. Specifically, the panel 10 is made from sheet metal, and preferably from aluminum sheet of an aluminum alloy such as 3003 H-14 or 3105 aluminum alloy. The panel 10 is typically 24 inches in width to match a standard grid module. However, a 30-inch width is also possible. The panel 10 may be perforated to improve acoustical performance. Additionally, acoustical materials (such as non-woven matt and insulation pads, rolls or batts) can be added to the back side of the panel 10 to improve sound absorption and reduce sound transmission.

The panel 10 has an edge perimeter comprising a hem 12 formed by folding the edges of the panel 10 back on themselves on all four sides. A preferred width for the hem is 0.472 inches, although other widths may be selected without departing from the invention. The panel hem design allows for the panel to curve to adapt to the profile of the suspension grid. The panels can conform to varying convex and/or concave contours in a single panel, with lengths up to 12 feet being contemplated, depending upon handling limitations.

With reference to FIGS. 1-5, a plurality of tabs 14 are formed integrally with the hem 12 spaced at intervals about the perimeter of the panel. As illustrated, the tabs 14 are generally rectangular in shape and have an overall dimension of 1½ inches by 11/16 inches, although other shapes and dimensions may be used. Each tab 14 is bendable relative to the hem 12 along a first axis to an angle of approximately 90° with respect to the panel 10. A minor portion 14*a* (measuring approximately ½ inch by 11/16 inch) of each tab 14 is bendable along a second axis at an obtuse angle with respect to the major portion 14*b* of the tab 14 to provide the portion of the tab that engages the flange 17*a* of the runner 17. The tab 14 is provided with slots or cutouts 16 along the first and second axes that facilitate bending of the tab as described above, although other techniques for predisposing the clip to bend at the desired locations may be used, such as pre-creasing the tab 14 along the first and second axes.

Figure 2:
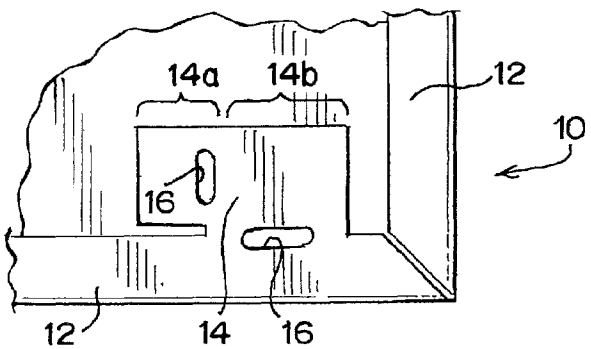
FIG. 2 is a fragmentary view of the ceiling panel of FIG. 1, enlarged to show detail.
Figure 3:
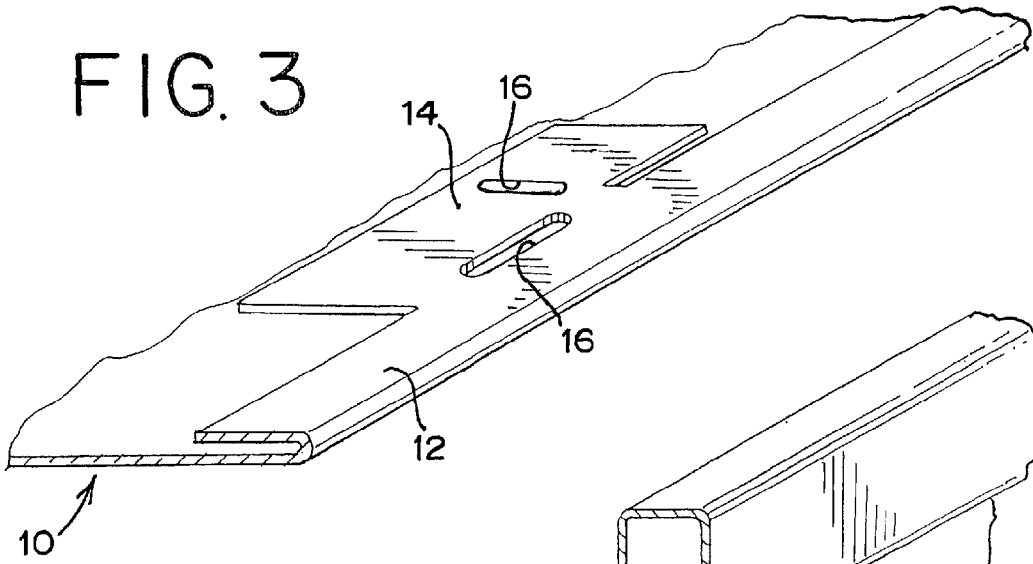
FIGS. 3 and 4 are fragmentary perspective views illustrating the process for securing the ceiling panel of FIG. 1 to a grid member or runner.
Figure 4:
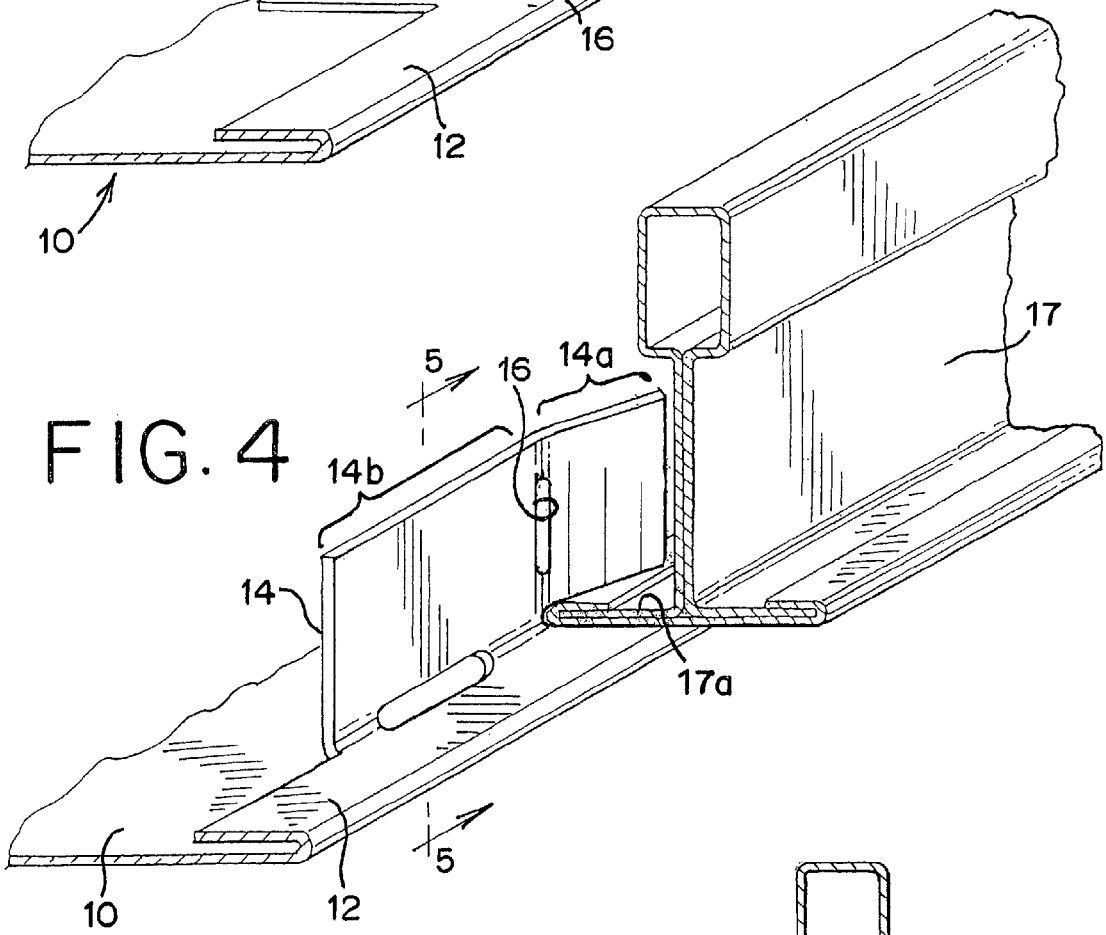
Figure 5:
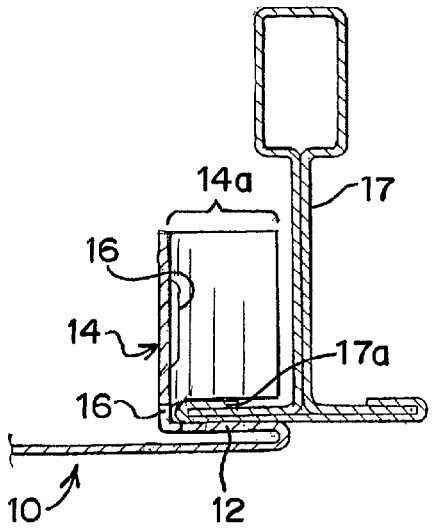
FIG. 5 is a cross-sectional view taken along line 5-5 in FIG. 4 showing the ceiling panel of FIG. 1 secured to a grid member.

The panels 10 are shipped with the tabs 14 unbent, as shown in, e.g., FIGS. 1-3. With reference to FIGS. 4 and 5, the panels 10 are secured to a grid member or runner 17 by first partially bending the tabs 14 along the first axis to help guide the panel 10 into the grid opening from below. Then, after the panel 10 is in position in the grid opening, the tabs 14 are bent along the second axis so that the minor portion 14*a* thereafter engages the back side of the horizontal flange 20 of the runner 17.

With reference to FIGS. 6-11, a second system for securing the ceiling panel 10 to the grid system is shown. In this system, a hemmed sheet metal panel 10 is also provided. However, instead of having tabs being formed integrally therewith, the hems 12 include pre-punched holes 22 (best seen in FIGS. 6 and 7) at spaced intervals that cooperate with a clip, generally designated 24, to locate and appropriately space the clips and to secure the clips to the panel.

Figure 6:
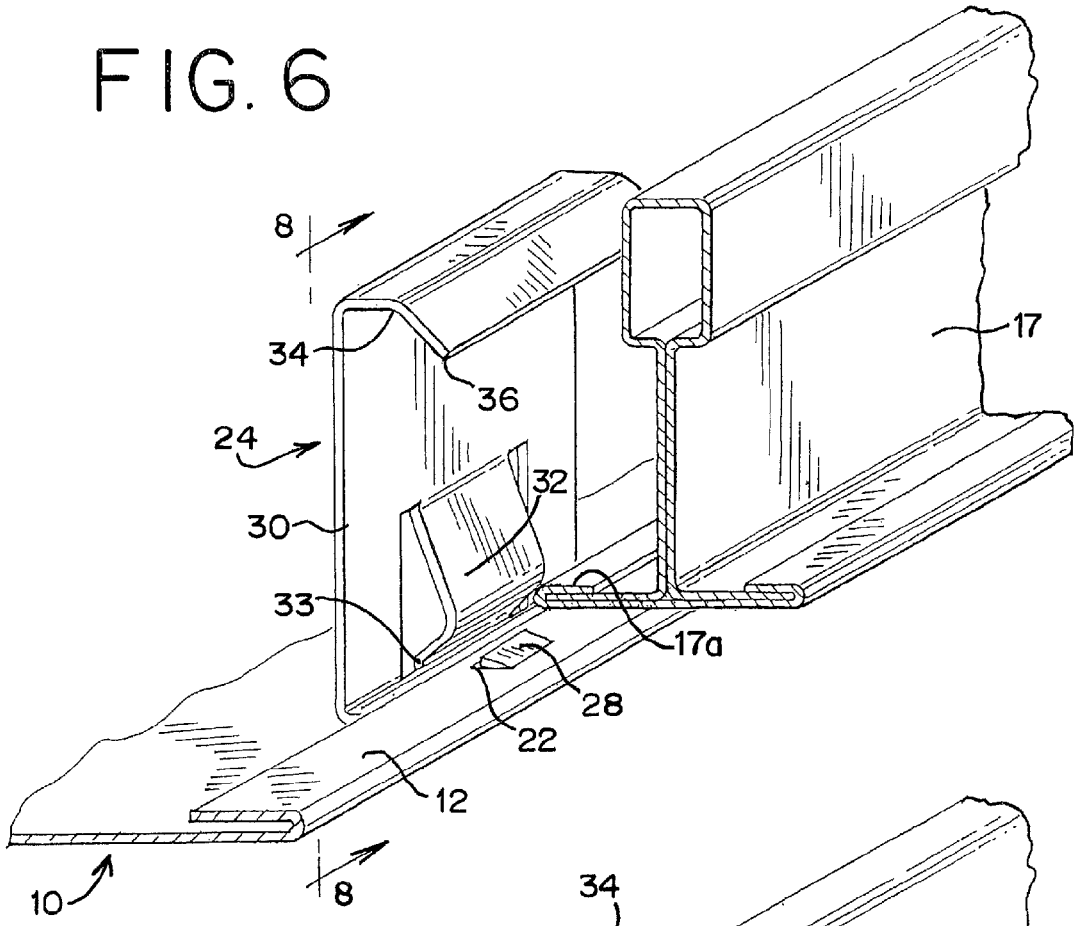

The clip 24 is generally L-shaped, with a first or lower leg 26 having a tab 28 being bent upwardly therefrom that is of a size and shape so that it can be received in the pre-punched hole 22 in the hem 12. A second, longer leg 30 of the clip includes a spring tongue or detent 32 that extends generally toward the first leg 26 of the clip. With reference to FIGS. 6, 8 and 10, the free end 33 of the detent 32 extends toward the edge of the panel 10, when the clip 24 is installed thereon, with an intermediate portion of the detent 32 being curved or bowed so as to overlie the flange 17*a* of the runner 17. During installation of the panel into the grid, the curved portion of the detent 32 pulls the panel 10 upwards and holds the panel hem 12 against the face of the grid. The clip 24 also includes an upper angled portion 34 that allows the panel to be initially installed below the face of the grid, with the free end 36 of the angled portion resting on the flange of the runner, thus allowing the panels 10 to be installed without the clip 24 interfering with the reinforcing bulb of the runners in the grid.

The panels secured to a grid by means of the clip 24 of FIGS. 6, 8 and 10 can be removed or demounted without a special tool by simply pulling downward at the edge of the panel and inserting a screw driver or bladed tool at the edge. By prying downwardly, the detent 32 can be disengaged from the flange of the runner and the panel lowered so that the free end of the upper angled portion 34 of the clip 24 rests on the flange of the runners. Final demounting of the panels is then accomplished by bending the vertical leg 30 by applying finger pressure to provide clearance between the angled portion 34 of the clip 24 and the flange 17*a* of the runner 17.

Figure 7:
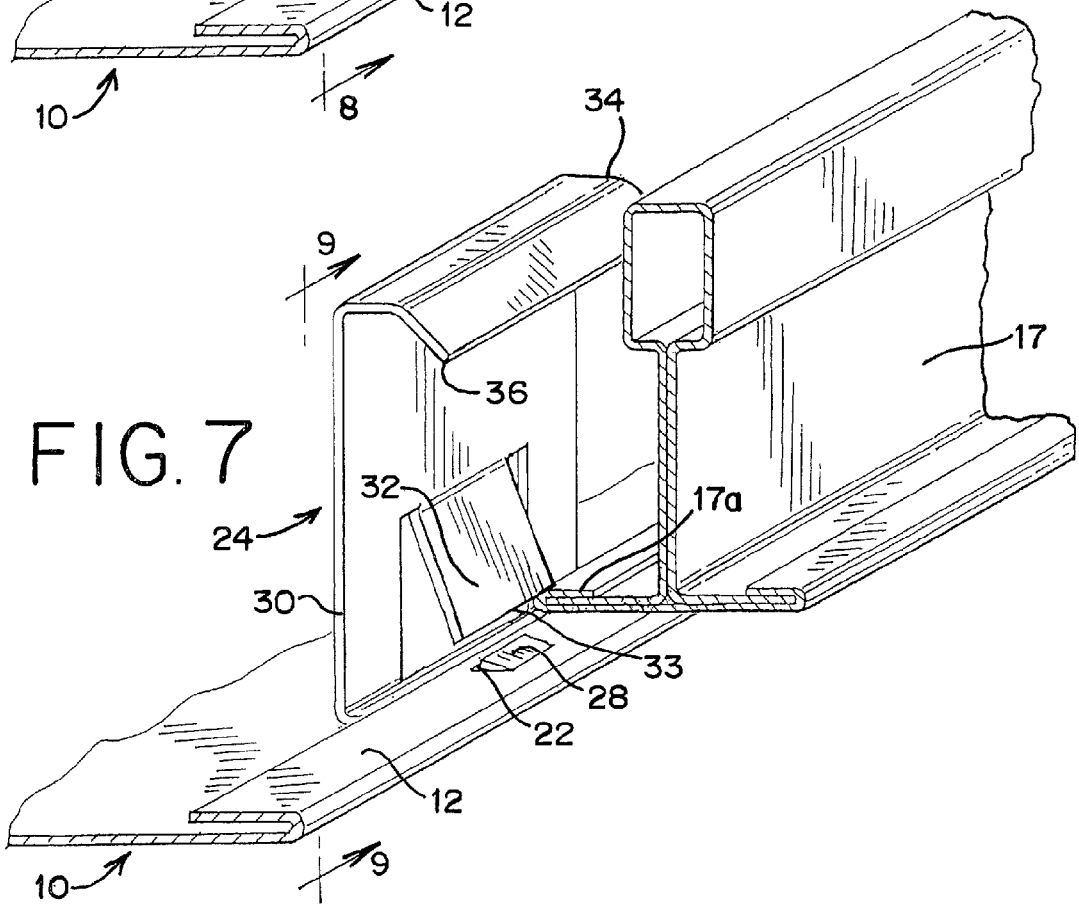

Alternatively, and as illustrated in FIGS. 7, 9 and 11, the spring tongue or detent 32 may be shortened so that it extends over the inner edge of the hem. When the panel is installed, using this clip, the free end 33 of the detent 32 engages the upper surface of the flange 17*a* of the support runner 17. As such, the spring clip 24 locks the panel in place, clamping the flange 17*a* of the grid between the detent 32 and the ceiling panel 10. Consequently, a special tool is required to remove a panel utilizing this clip embodiment, such as the tool 40 shown in FIG.12. The tool 40 has a working end 42 that is inserted between the hem of the panel and the bottom of the flange of the runner and then slid along the edge thereof to disengage the detent 32 from the top of the flange.

Thus, a system has been provided for securing a ceiling panel to a grid system in a manner that conceals the grid system from view. While the inventions disclosed in the present application are intended to be used with a curved suspension grid, they may also be used with a standard flat suspension grid without departing from the invention.

The invention claimed is:

1. A ceiling panel for use in a suspended ceiling system having a support grid comprising a plurality of runners having flanges thereon adapted to support ceiling panels, the ceiling panel comprising a sheet of metal having a plurality of edges, each of the edges being folded back onto the panel along respective axes to collectively form a hem, the respective axes at which the edges are folded back defining an outer perimeter of the panel, the panel having a surface extending between the respective axes at which the edges are folded back, the hem formed by the folded back edges being substantially parallel to the surface and extending inward from the outer perimeter of the panel, at least two of the edges having a plurality of tabs extending from and formed co-planar with the hem wherein the plurality of tabs are spaced apart along each of the respective at least two of the edges, each tab having first and second portions, the first portion being directly attached to the hem and being bendable about a first tab axis that is parallel to the axis along which the respective edge is folded back and the second portion being attached to the first portion and being bendable about a second tab axis that is substantially perpendicular relative to the first tab axis.

2. The ceiling panel of claim 1 wherein each tab includes a first aperture lying along the first tab axis and a second aperture lying along the second tab axis.

3. The ceiling panel of claim 1 wherein each tab is configured so as to have the tab first portion be predisposed to being bent about the first tab axis and the tab second portion be predisposed to being bent about the second tab axis.

4. The ceiling panel of claim 1 wherein each tab first portion is bendable to extend substantially perpendicular to the hem.

5. The ceiling panel of claim 4 wherein each tab second portion is bendable to extend at an angle relative to the tab first portion so as to form a gap configured to receive a flange of a support grid between the tab second portion and the hem.

6. A ceiling panel for use in a suspended ceiling system having a support grid comprising a plurality of runners having flanges thereon adapted to support ceiling panels, the ceiling panel comprising a sheet of metal forming an expansive panel surface for suspension substantially below and adjacent to the flanges of the support grid, the ceiling panel having an outer perimeter formed by respective axes along which outer edges of the ceiling panel are folded back so as to form a hem that is in a first plane substantially parallel to the expansive panel surface, spaced apart tabs being formed along each of at least two of the folded back edges with the tabs extending from and formed co-planar with the hem, each tab having first and second portions, the first portion being directly attached to the hem and configured so as to be predisposed to being bent about a first tab axis out of the first plane and the second portion being attached to the first portion and being configured so as to be predisposed to being bent about a second tab axis out of a second plane that is defined by the first portion and into a third plane that intersects the first plane and wherein the first tab axis and the second tab axis intersect.

7. The ceiling panel of claim 6 wherein each tab includes a first aperture lying along the first tab axis and a second aperture lying along the second tab axis.

8. A method of installing a ceiling panel to a support grid of a suspended ceiling system wherein the support grid of the suspended ceiling system comprises a plurality of runners having flanges thereon adapted to support ceiling panels, the ceiling panel comprising a sheet of metal forming an expansive panel surface for suspension substantially below and adjacent to the flanges of the support grid, the ceiling panel having an outer perimeter formed by respective axes along which outer edges of the ceiling panel are folded back so as to form a hem that is in a first plane substantially parallel to the expansive panel surface, spaced apart tabs being formed along each of at least two of the folded back edges with the tabs extending from and formed co-planar with the hem, each tab having first and second portions, the first portion being directly attached to the hem and configured so as to be predisposed to being bent about a first tab axis out of the first plane and the second portion being attached to the first portion and being configured so as to be predisposed to being bent about a second tab axis out of a second plane that is defined by the first portion and into a third plane that intersects the first plane, the method comprising the steps of:

locating the ceiling panel below and adjacent at least a pair of flanges of a support grid;

bending the first portion of each respective tab that is located along the respective flanges to a position in the second plane;

bending the second portion of each respective tab that is located along the respective flanges to a position that is in the third plane wherein a portion of a flange is disposed between the hem and the second portion of the tab to secure the ceiling panel.

* * * * *